US005542785A

United States Patent [19]

Cloud

[11] Patent Number: 5,542,785

[45] Date of Patent: Aug. 6, 1996

[54] REBAR CAGE WHEEL SPACER CENTRALIZER SYSTEM FOR DRILLED SHAFTS

[75] Inventor: George T. Cloud, Lithia Springs, Ga.

[73] Assignee: Lowtech Corporation, Inc., Lawrenceville, Ga.

[21] Appl. No.: 127,802

[22] Filed: Sep. 28, 1993

[51] Int. Cl.[6] ..... E02D 5/30

[52] U.S. Cl. ..... 405/239; 52/169.6; 52/649.4; 52/677; 249/83; 405/256

[58] Field of Search ..... 52/169.9, 649.2, 52/649.3, 649.4, 677, 684, 685, 686, 687; 249/83, 91; 405/239, 256, 257; 248/74.3, 74.4

[56] References Cited

U.S. PATENT DOCUMENTS

| | | | |
|---|---|---|---|
| D. 223,701 | 5/1972 | Lausch . | |
| 790,230 | 5/1905 | Stempel . | |
| 1,356,315 | 10/1920 | Scofield et al. . | |
| 1,708,277 | 4/1929 | Martin . | |
| 1,946,418 | 2/1934 | Welch . | |
| 2,612,024 | 9/1952 | Hunsucker . | |
| 3,191,345 | 6/1965 | Schwachula . | |
| 3,257,767 | 6/1966 | Lassy . | |
| 3,280,529 | 10/1966 | Reuss . | |
| 3,471,986 | 10/1969 | Swenson . | |
| 3,722,164 | 3/1973 | Schmidgall . | |
| 4,612,680 | 9/1986 | Daiguji | 248/74.3 X |
| 4,627,211 | 12/1986 | Foster, Jr. . | |
| 4,741,143 | 5/1988 | Foster, Jr. . | |
| 5,027,478 | 7/1991 | Suhr . | |
| 5,347,787 | 9/1994 | Gavin | 52/677 |
| 5,359,829 | 11/1994 | Voita | 52/649.4 X |

FOREIGN PATENT DOCUMENTS

| | | | |
|---|---|---|---|
| 25522 | 6/1963 | Germany | 52/677 |
| 1484980 | 1/1969 | Germany | 52/677 |
| 2140424 | 3/1973 | Germany | 52/677 |
| 2427829 | 1/1976 | Germany | 52/677 |
| 434659 | 10/1967 | Switzerland | 52/677 |
| 623942 | 5/1949 | United Kingdom | 52/677 |

OTHER PUBLICATIONS

"Centraligner Pier Sleds" by Pieresearch, 2 pages, 1990.

*Primary Examiner*—Carl D. Friedman
*Assistant Examiner*—Kevin D. Wilkens
*Attorney, Agent, or Firm*—Hopkins & Thomas

[57] ABSTRACT

A spacer (20) is mounted on a lateral rebar tie (13) of a reinforcement cage (11) of a poured concrete foundation support. The spacer (20) includes a pair of interlocking wheel members (21 and 22) which lock the wheel members (21 and 22) together in a mated interlocked relationship rotatably mounted about a lateral tie (13) of the reinforcement cage (11) to form the spacer (20). As the reinforcement cage (11) is inserted into an excavated shaft, the outer side wall (32) of the spacer (20) engages and rolls along the side wall thereof. The engagement of the side wall of the excavated shaft by the spacers (20) centers the reinforcement cage within the excavated shaft and maintains the reinforcement cage in its centered position as the excavated shaft is filled with concrete.

1 Claim, 3 Drawing Sheets

REBAR CAGE WHEEL SPACER CENTRALIZER SYSTEM FOR DRILLED SHAFTS

FIELD OF THE INVENTION

This invention relates in general to the formation of in-ground concrete foundation structures such as concrete pilings, piers and caissons. In particular, the present invention relates to a reinforcing cage for placement in a drilled or excavated shaft in which concrete is to be poured. The present invention is a wheel spacer assembly adapted to be quickly and easily mounted to the lateral rebar ties of the reinforcement cage. The wheel spacer assemblies engage the side wall of the drilled or excavated shaft into which the reinforcement cage is being inserted and maintain the reinforcement cage in a position approximately centered within the excavated shaft of the foundation support as the cage is telescopically inserted into the shaft and later as concrete is poured into the shaft to form the foundation structure.

BACKGROUND OF THE INVENTION

It is well known in the construction and building industry that concrete structures require reinforcement means during the formation of the structures. Such reinforcement means typically are steel reinforcing bars or rods commonly known as "rebar".

The general procedure followed for forming a concrete foundation support structure such as a concrete pier involves drilling or excavating a shaft or hole in the ground at a predetermined location. A reinforcement cage is formed from reinforcing steel and is inserted into the excavated shaft. The reinforcement cage typically is fabricated above ground from a series of elongated steel rebar or similar reinforcement materials. The steel rods are arranged in a substantially parallel cylindrical array and are bound together in this configuration by laterally oriented rebar ties. The rebar ties typically are circular sections of rebar fitted about the parallel steel rods at several locations along the lengths of the parallel rods and tied thereto with conventional tie-wire. Another configuration of the laterally extending rebar ties is a single elongated section of rebar that is wound about the parallel steel rods in a helical configuration. The ties are connected to the reinforcement cage at points of contact between the parallel rods and the rebar ties by tie-wire. The rebar ties hold the parallel rods in an elongated cylindrical cage configuration. The assembled steel reinforcement cage is inserted into the drilled or excavated shaft prior to the pouring of concrete therein.

As the concrete is poured, it is necessary that the steel reinforcement cage be properly centralized and positioned within the excavated shaft in order to form a solid and stable foundation support such as a pier or caisson. A problem faced by drilled shaft contractors is trying to insert the reinforcement cage into the excavated shaft and maintain the reinforcement cage in a centered alignment within the excavation shaft without the reinforcement cage being shifted toward or engaging the side wall of the excavation shaft as concrete is poured therein to form the foundation structure.

In order to solve this problem of maintaining the reinforcement cage in a centered position within the excavated shaft, it is common among drilled shaft foundation contractors to use spacers mounted to the horizontally oriented rebar ties of the reinforcement cages. The spacers engage the side wall of the excavation shaft and prevent the reinforcement cages from shifting toward or becoming engaged with the side walls of the excavated shaft. The spacers maintain the reinforcement structures in a centered position within the shaft, spaced from the side wall thereof.

There are several types of prior art structures used as spacing devices or in common use as spacing devices for the construction of concrete foundation structures. The prior art spacers usually are installed on the reinforcement cage at the building site. The first type of spacer generally used is a simple solid concrete wheel that is formed in the field from waste concrete. These solid concrete spacers typically are circularly shaped with an opening in the middle thereof. A problem with such concrete wheels is that they are heavy and not easy to manipulate and are difficult and time consuming to produce and to install on the rebar ties of the reinforcement cages, as the wheels must be threaded onto the rebar ties and secured in place during the construction of the reinforcement cages. This usually requires the rebar ties to be separated from the parallel rods so that an end of a rebar tie can be telescopically threaded through the central opening of the concrete wheel, and after the wheel has been threaded onto the rebar tie, the rebar tie must be reconnected to the parallel bars. Such an operation usually is very labor intensive and expensive, as it is generally skilled steel workers that are used to construct and install the reinforcement cages.

Other prior art designs have included large plastic open-spoke wheel spacers having slotted openings formed therein. These open spoke wheel spacers are adapted to simply slide over and rest upon the rebar ties of the reinforcement cages. Such open-spoke wheel spacers generally are not very sturdy and are easily twisted and can be easily dislodged from the ties of the reinforcement cage, especially as the reinforcement cages are being inserted into the excavated shafts.

Another type of spacer assembly being used with concrete reinforcement cages is a "sled" design spacer illustrated in U.S. Pat. Nos. 4,627,211 and 4,741,143. Both of these patents illustrate a plastic or concrete sled of a substantially D-shaped design and which is attached to the ties of the reinforcement cage by conventional tie-wire. A problem with such spacers is that, while such spacers might aid in the centering of the reinforcement cage as it is inserted into the excavated shaft, as the concrete is poured into the shaft, the force of the concrete entering the shaft tends to exert a torque or twisting force on the reinforcement cage. This torquing of the reinforcement cage may break or untwist the tie-wires holding the spacers to the reinforcement cage, causing them to become unstable and lay over, which allows the reinforcement cage to shift or twist out of proper position. Thus, the reinforcement cage can become uncentered within the excavated shaft.

Additionally, such spacers are still difficult, labor intensive and time consuming to install as they must be tied at several points to the reinforcement cage structure to secure the spacers thereto. Additionally, the tie-wire connectors for these spacers can easily rust and become brittle and therefore can easily break during attachment of the spacers to the reinforcement cage or as stresses are placed on the spacers during insertion of the reinforcement cage and pouring of concrete into the excavated shaft.

Another problem with this type sled spacer is that it is relatively heavy, which requires increased shipping costs.

Further, the installation of the sled spacers which are tied to the cage is labor intensive.

Accordingly, it can be seen that it would be desirable to provide reinforcement cages for concrete structures having spacers which maintain the reinforcement cage in a centralized position within an excavated shaft for the concrete structure, and which is easy to install and use and which resists the torque or twisting forces exerted on the reinforcement cage during the insertion of the reinforcement cage into the excavated shaft and during the pouring of concrete therein.

SUMMARY OF THE INVENTION

Briefly described, the present invention comprises a reinforcement cage wheel spacer assembly for a concrete foundation support structure such as concrete pilings, caissons or piers. The reinforcement cage, when installed, typically includes a series of parallel, vertically oriented reinforcement steel bars or rods, commonly known as "rebar", bound together in a substantially cylindrical configuration by laterally oriented rebar ties positioned along the lengths of the parallel rods. Wheel assemblies which function as spacers for the reinforcement cage are formed of elements that are easily attached to each other and which form an axle opening for placement about the laterally extending rebar ties of the cage. In a preferred embodiment of the invention, the wheel elements which fit together to form the spacer wheels are of identical construction and are adapted to mate together in an interlocking relationship. Each of the wheel elements typically is molded from plastic material, although other types of materials can be utilized as well. Each wheel element includes a central web and an outer side wall that extends in a semicircular path about the web and is attached thereto. A semi-cylindrical recess is formed approximately in the center of the web of each wheel element. When two wheel elements are assembled around the rebar tie, the recesses mate with each other and form a hub having an axle opening which allows the assembled wheel arrangement to rotate about the rebar tie while maintaining clearance for the rebar cage from the drilled or excavated walls.

Locking means are formed along the length of the webs of the wheel elements, positioned at facing surfaces of mated wheel elements. The locking means include pairs of locking tabs that project from the webs in a direction normal to the webs. Each locking tab is a relatively flat tongue of a width approximately to half the width of the web of each wheel element and is attached at one end to the web of its wheel element. An angled catch or ridge is formed at the opposite end of each locking tab for engaging a portion of an opposing wheel element.

Substantially rectangular notches are formed in the webs of the wheel elements at positions corresponding approximately to the position of the locking tabs of an opposed wheel element. Each of the notches includes an open end, parallel side walls, and a closed end having a slanted bearing surface. A tapered side edge of each of the locking tabs engages the bearing surfaces formed at the closed ends of the notches as the locking tabs are inserted into the notches as the wheel elements are placed together. The engagement of the tapered side edges of the locking tabs with the bearing surfaces of the notches helps guide the locking tabs into the notches of the webs to insure that the catches of the locking tabs will engage the webs of the opposed wheel elements to lock the wheel elements together about a lateral rebar tie of the reinforcement cage.

Once so interlocked together, the resultant spacer formed by the wheel members functions as a wheel or roller that is rotatably mounted on a lateral rebar tie of the reinforcing cage. Accordingly, as the reinforcement cage is inserted into an excavated shaft or hole for the foundation support, the spacer tends to engage and roll along the side wall of the excavated shaft. The engagement of the rotatable wheels with the side wall of the excavated shaft facilitates the insertion of the reinforcement cage into the excavated shaft. The engagement of the wheels with the side wall of the excavated shaft also tends to center the reinforcement cage in a desired orientation positioned approximately in the center of the excavated shaft. The wheels help to prevent the reinforcement cage from twisting or engaging the side wall of the excavated shaft or from becoming otherwise misaligned in response to the torque created as concrete is poured into the excavated shaft to form the foundation support structure.

DETAILED DESCRIPTION OF THE PREFERRED EMBODIMENT

Referring now in greater detail to the drawings in which like numerals indicate like parts throughout the several views, the present invention comprises a rebar cage wheel spacer assembly 20 (FIG. 1) for use in preparation for pouring an in-ground concrete structure such as a foundation caisson or pier formed from poured concrete. The reinforcement cage assembly 11 is a generally cylindrically shaped structure formed from reinforcing steel, commonly referred to as "rebar." The reinforcement cage includes a series of spaced apart reinforcing rods 12 typically formed from rebar of a desired size selected according to the size of the concrete foundation support to be formed.

Figure 1:
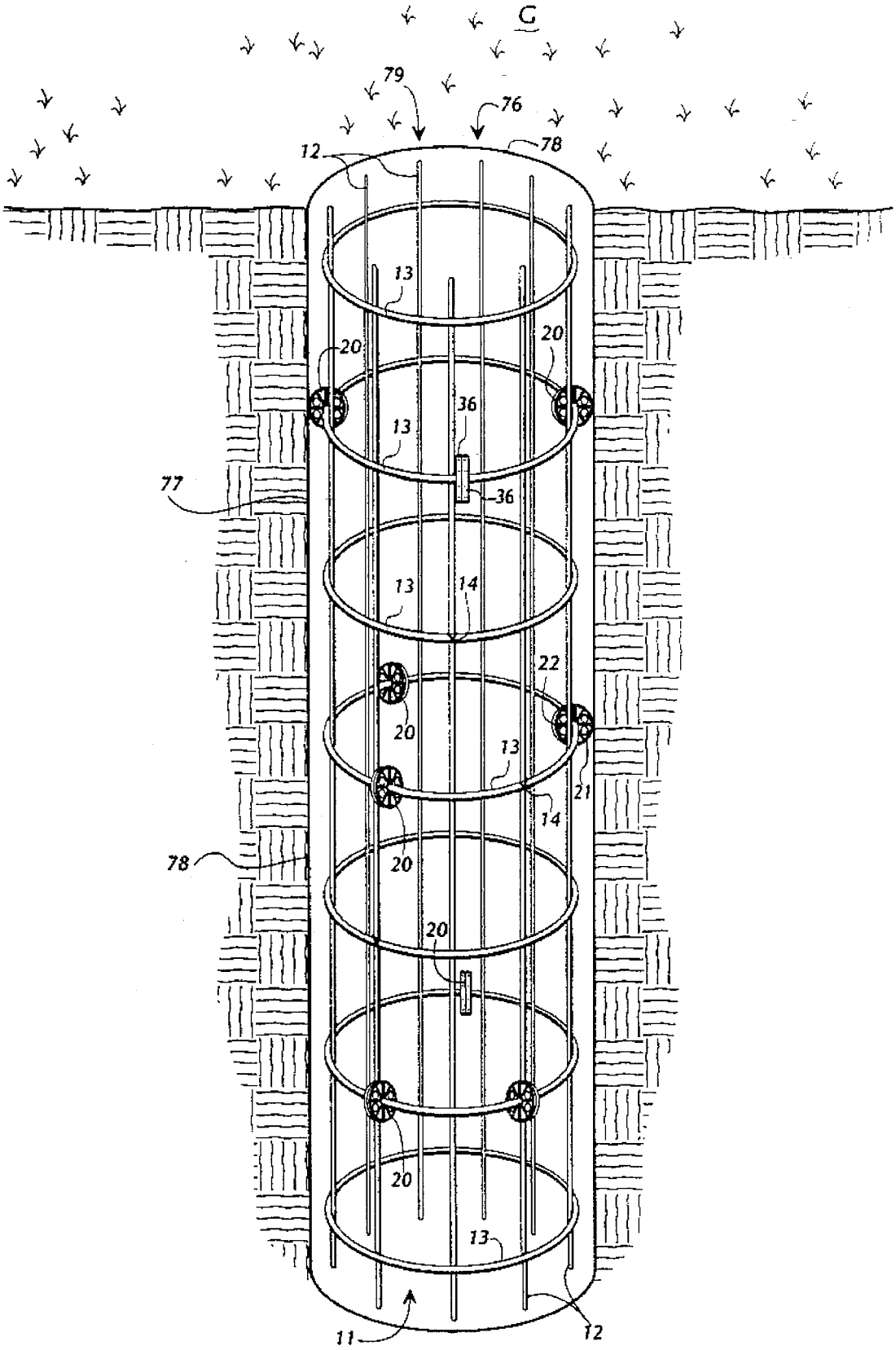
FIG. 1 is a cut away perspective illustration of the reinforcement cage assembly positioned within an excavated shaft for forming a foundation support structure, with wheel spacer assemblies in place.

The reinforcing rods are arranged in a cylindrical pattern or configuration and are bound together by substantially laterally oriented rebar ties 13. The rebar ties can be formed with a circular shape as illustrated in FIG. 1, or can also be a single elongated section of reinforcing steel wound about the length of the reinforcing rods 12 in a helical configuration. The rebar ties 13 are placed about and positioned along the length of the reinforcing rods 12 and are attached thereto by a connecting means such as tie-wire 14. The resultant assembly forms a substantially cylindrically shaped reinforcement cage 11.

Figure 2:
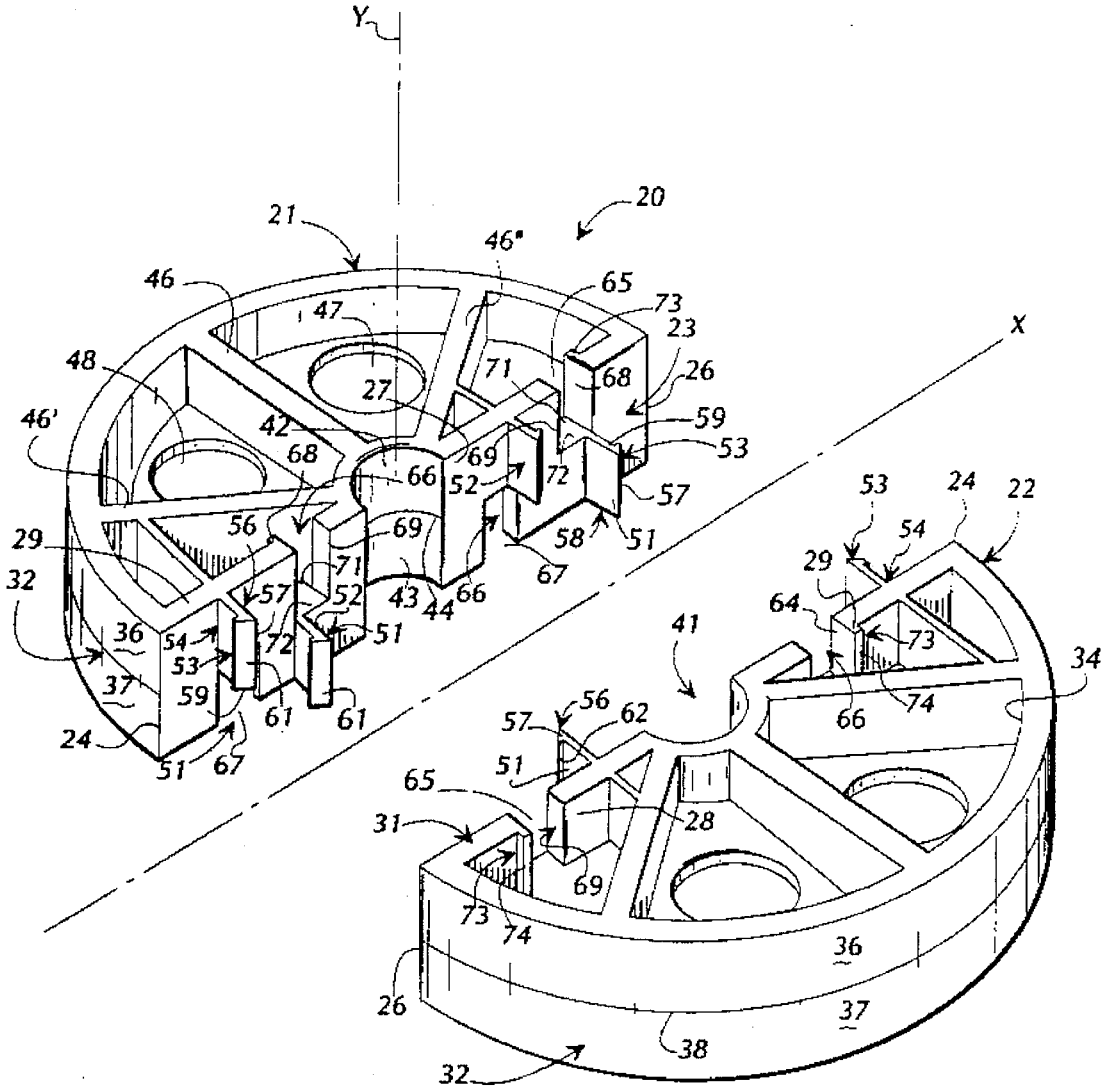
FIG. 2 is a perspective illustration of a pair of wheel members.

As illustrated in FIG. 1, a series of wheel assemblies 20 which function as spacers are mounted on the reinforcement cage 11. As FIG. 2 shows, each spacer 20 is formed from a pair of identical substantially semi-cylindrically shaped interlocking wheel members 21 and 22 which, when assembled, form rotatable wheel assemblies. The wheel members 21 and 22 typically are formed from a high strength plastic material such as a high density polyethylene or similar plastic. It will, however, be understood by those skilled in the art that other materials, other than plastic, could be used. The wheel members which, in the preferred embodiment, are identical wheel halves, are formed having the same construction and are designed to be snapped together by hand to form the assembled spacer 20.

The wheel members 21 and 22 each include a diametrical web 23 which extends along a diametrical axis X. Each web 23 includes a pair of spaced apart ends 24 and 26, a facing side surface 27, a rearward side surface 28, and first and second longitudinal edges 29 and 31.

Figure 3:
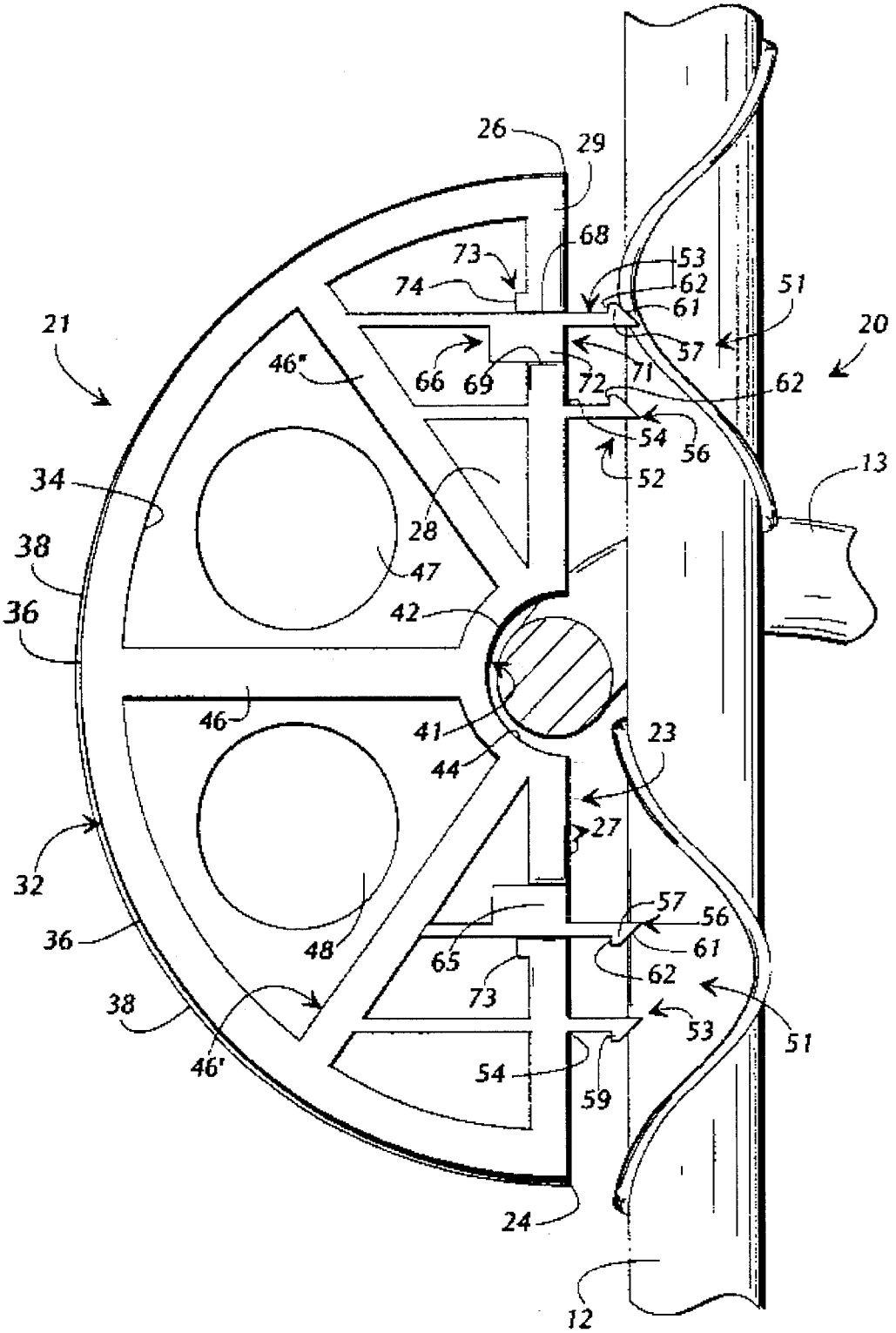
FIG. 3 is a side elevational view of a single wheel member positioned on a lateral tie of a reinforcement cage.

As FIGS. 2 and 3 illustrate, a curved outer side wall 32 extends between the ends 24 and 26 of each wheel member 21 in a semicircular path. The semicircular path of the outer side wall 32 between the ends of the web gives each wheel member a substantially D-shaped semi-cylindrical appearance. As illustrated in FIG. 2, the outer side walls 32 have bearing surfaces 36 and 37, each oriented at a slight angle, forming a ridge 38. The ridge 38 is formed approximately in the center of each outer side wall 32 at the intersection of the angled bearing surfaces.

As FIGS. 2 and 3 illustrate, a recess portion or axle opening 41 is formed within each web 23 of each wheel member 21. The recess portions 41 are substantially semi-cylindrically shaped and are formed intermediate the ends 24 and 26 of the webs 23, formed approximately in the center of each web. Each recess portion 41 has bearing surfaces 42 and 43 that taper at a slight angle toward the normal axis Y of the wheel members, forming a ridge 44 approximately in the center of each recess portion 41. As FIGS. 2 and 3 illustrate, the recess portions 41 formed in the webs 23 of the wheel members are adapted to register with each other and fit about a lateral rebar tie 13 of the reinforcement cage assembly 11. In their opposed registered position fitted about a lateral rebar tie, the recess portions function as a hub which engages and receives the rebar tie therein to enable the wheel members to rotate about the rebar tie 13.

As shown in FIGS. 2 and 3, a series of spokes 46, 46', and 46" project radially between the recess portions and the inward side surfaces 34 of the outer side walls 32 of each wheel member 21 and 22 (FIG. 2). Substantially circular bores or openings 47 and 48 are formed between the spokes 46 and 46' and 46 and 46" and the inward side surface 34 of outer side wall 32 of each wheel member. The bores 47 and 48 enable the passage of concrete through the wheel members of the spacer 20 to enable the concrete to completely surround and enclose the spacer as it fills the excavated shaft.

As illustrated in FIG. 2, locking means 51 are formed along the webs 23 of the wheel members 21 and 22, positioned intermediate the recess portions 41 and the ends 24 and 26 of the webs 23. The locking means 51 each include pairs of locking tabs 52 and 53 that project laterally from the facing side surfaces 27 of the webs 23 of the wheel members 21 and 22. The locking tabs of a width approximately equivalent to half the width of the webs 23 of the wheel members are positioned on opposite sides of the longitudinal central axis X of each wheel member.

Each locking tab is a substantially flat strip or tongue integrally formed as part of the web. The locking tabs extend from a first end or base 54 in a direction normal to the diametrical axis of the webs. The locking tabs 52 and 53 each have a distal end 56, having a substantially triangularly shaped catch or hooked portion 57 formed thereat. The locking tabs further include substantially flat outer side edges 58 and inward side edges 59 that are tapered or angled from the base end 54 to the distal ends 56 of the locking tabs 52 and 53. The catches 57 formed at the ends 56 of the locking tabs each include a slanted front bearing surface 61 and a substantially flat rear bearing surface 62 intersecting with the front slanted bearing surface 61.

As FIG. 2 illustrates, notches 65 and 66 are formed in the webs 23 of each wheel member 21 and 22, positioned adjacent the locking tabs 52 and 53 of each web of each wheel member and aligned with the locking tabs of the web 23 of the opposite wheel member 21 or 22. The notches 65 and 66 are substantially rectangular openings formed in the webs 23. Each notch 65 and 66 extends between the first and second longitudinal edges 29 and 31 and the longitudinal axis X of each web. Each notch has an open end 67, parallel side walls 68 and 69, and a closed end 71 formed approximately adjacent the central axis of each web. Angled bearing surfaces 72 are formed at the closed ends 71 of each notch 65 and 66. The bearing surfaces 72 act as guide surfaces that are positioned to engage the tapered inward side edges 59 of the locking tabs 52 and 53 as the wheel members are urged together, to guide the locking tabs into the notches formed within the webs.

As shown in FIG. 2, an angled bearing surface 73 is formed along each side wall 68 of each notch 65 and 66, extending laterally from the rearward side surfaces 28 of the webs 23. A catch surface 74 is formed at the rearward edge of bearing surface 72 against which the rear bearing surfaces 62 of the catches 57 of the locking tabs 52 and 53 engage and bear there against. The engagement of the catch surfaces by the rear bearing surfaces 62 secures the locking tabs of each wheel member 21 or 22 to the webs of their opposing wheel member 21 or 22 to secure the wheel members in an interlocked, mating relationship about a rebar tie, to form the spacer 20.

OPERATION

In operation of the reinforcement cage 11, as shown in FIGS. 1 and 3, spacers 20 are each rotatably mounted upon a lateral rebar tie 13 of a reinforcement cage 11 for a concrete reinforcing structure. As illustrated in FIG. 1, the spacers 20 are placed on the lateral rebar ties 13 at spaced intervals and locations as desired. A minimum of three spacers 20 would be used on a single rebar tie 13 to center the reinforcement cage assembly at that point. Additional spacers 20 would be used on additional rebar ties 13 as needed, depending on the depth of the excavated shaft 16 and the spacing of the rebar ties 13.

The wheel members 21 and 22 are positioned along the length of the lateral rebar ties 13 with the lateral rebar ties 13 received and nestled within the recess portions 41 of the wheel members, as illustrated in FIG. 3. The slight inward taper of the bearing surfaces 42 and 43 (FIG. 2) of the recess portions 41 enables the recess portions to approximately correspond to the curvature of the circular ties of the reinforcement cage. Once so positioned on the lateral rebar ties of the reinforcement cage, the opposed wheel members 21 and 22 are urged together. As the wheel members are pressed into contact with one another, the tapered inward side edges 59 of the locking tabs 52 and 53 (FIG. 2) engage the lower bearing surfaces 72 of the notches 65 and 66 formed in the webs 23 of the wheel members and are guided into the notches. As the locking tabs are received within the notches, the angled front bearing surfaces 61 of the catches 57 of the locking tabs engage and slide along the angled bearing surfaces 73 of the side walls 68 of the notches, which biases the locking tabs away from the side walls 68.

The wheel members are urged together until their web portion(s) engage one another. At this point, the catches are extended slightly past the edges of bearing surfaces 73 of the side walls 68 of the notches. The resiliency of the locking tabs urges the locking tabs against the projections, the flat rear bearing surfaces 62 of the catches in engagement with the catch surfaces 74 of the side walls 68 of the notches 65 and 66. The engagement of the rear bearing surfaces 62 of the catches 57 with the catch surfaces 74 of the notches secures the wheel members together in a fixed, interlocked arrangement, rotatably mounted about a lateral rebar tie of the reinforcement cage assembly with the lateral rebar tie received within the recess portions of the webs of the wheel members.

The spacer formed by the interlocking of the wheel members functions as a wheel or roller, which rotates about the lateral rebar tie on which it is mounted. The engagement of the bearing surfaces of the recess portions with the lateral rebar ties permits free rotation of the spacer about the lateral rebar tie.

As illustrated in FIG. 1, following installation of the spacers 20 on the reinforcement cage assembly 11, the reinforcement cage 11 is inserted into an excavated shaft 76 drilled or dug into the ground G at a desired location in which a concrete foundation structure such as a pier or piling is to be formed. The excavated shaft 76 is typically a cylindrical shaft having a side wall 77 and is dug or drilled into the earth a predetermined distance and typically has a diameter slightly greater than the diameter of the finished foundation support. Under some circumstances, a cylindrical tube or casing 78 is inserted into the excavated shaft adjacent the side wall 77 thereof to prevent collapse of the excavated shaft as the reinforcement cage assembly 11 is inserted therein. The casing 78 can be left within the excavated shaft if desired or can be removed from the excavated shaft once the reinforcing cage 11 has been positioned within the excavated shaft and in conjunction with the introduction of concrete into the excavated shaft, as shown by Arrows 79.

As the reinforcement cage assembly 11 is inserted into the excavated shaft 76, the spacers 20 engage and roll along the side wall 77 of the excavated shaft. The engagement of the side wall of the excavated shaft by the spacers centers the reinforcement cage assembly and prevents the reinforcement cage assembly from tilting or leaning and thereby engaging the side wall of the excavated shaft.

Once the reinforcement cage assembly 11 has been positioned approximately centered within the excavated shaft, concrete is poured into the excavated shaft in the direction of Arrows 79. As the concrete is poured into the excavation shaft, the force of the concrete tends to exert a torque or twisting force on the reinforcement cage. The engagement of the bearing surfaces 36 and 37 (FIG. 2) of the outer side walls of the spacers tends to resist the tendency of the reinforcement cage assembly 11 (FIG. 1) to twist or turn in response to the torque exerted by the flow of the concrete into the excavated shaft. Thus, the positioning of the reinforcement cage assembly within the center of the excavated shaft is maintained by the spacers as the excavated shaft is filled with concrete.

The present invention thus provides a means to stabilize reinforcement cage assembly that is self-centering and maintains its alignment centered within an excavated shaft for a poured concrete foundation support and that is simple and easy to install without requiring skilled or additional labor. The present invention further effectively reduces twisting or turning of the reinforcement cage assembly in response to the torque or twisting forces exerted by the pouring of concrete into the excavated shaft to form the poured concrete foundation support.

Although the wheel assemblies have been disclosed as comprising identical interfitting semicircular wheel halves, it will be understood that the wheel elements do not have to be identical wheel halves.

It will be understood by those skilled in the art that while a preferred embodiment of the invention has been disclosed herein, numerous modifications and changes can be made thereto without departing from the spirit and scope of the invention as set forth in the following claims.

I claim:

1. A method of installing an elongated reinforcing cage for a concrete pier in an excavation, with the rebar cage comprising elongated bars arranged substantially parallel to one another and in a cylindrical array, and rebar ties extending laterally about said bars and connected to said bars, said method including the steps of:

aligning the rebar cage with the excavation;

moving the cage telescopically into the excavation;

as the cage is aligned with the excavation, assembling duplicate wheel halves together with recesses in the diametrical webs of the wheel halves forming a central opening that extends about the rebar ties of the cage and with locking means along the webs, and in response to urging the wheel halves together locking the diametrical webs together with the locking means about the ties and between the rods to form wheel spacer assemblies on the rebar ties with each wheel spacer assembly protruding laterally from the cage;

as the cage is moved telescopically into the excavation, engaging some of the wheels against the surface of the excavation to maintain the cage away from contact with the surface of the excavation; and pouring concrete in the excavation about the cage and wheel spacer assemblies.

* * * * *